US005957599A

United States Patent [19]

Yamada

[11] Patent Number: 5,957,599

[45] Date of Patent: Sep. 28, 1999

[54] SHEET TRANSPORT UNIT AND RECORDER

[75] Inventor: Noriyuki Yamada, Tsushima, Japan

[73] Assignee: Brother Kogyo Kabushiki Kaisha, Nagoya, Japan

[21] Appl. No.: 08/937,449

[22] Filed: Sep. 25, 1997

[30] Foreign Application Priority Data

Sep. 30, 1996 [JP] Japan ..... 8-258618

[51] Int. Cl.[6] ..... B41J 13/02

[52] U.S. Cl. ..... 400/636; 400/636.3; 400/641

[58] Field of Search ..... 400/624, 635, 400/636, 629, 636.3, 641

[56] References Cited

U.S. PATENT DOCUMENTS 5,506,606 4/1996 Saikawa et al. ..... 400/624
5,594,486 1/1997 Kiyohara .
5,672,019 9/1997 Hirmatsu et al. ..... 400/624
5,697,716 12/1997 Akahane ..... 400/624
5,727,890 3/1998 Stodder et al. ..... 400/624

*Primary Examiner*—John Hilten
*Attorney, Agent, or Firm*—Oliff & Berridge, PLC

[57] ABSTRACT

A recorder comprises, a conveying roller for sending off sheets one by one from stacked sheets of paper; a sheet support biased toward the conveying roller; an feed roller positioned upstream a recording head and downstream the conveying roller; and a spring for biasing the feed roller downstream. The rotation shaft of the feed roller is supported with a bearing. The conveying roller has a semi-cylindrical shape, and the rotation shaft of the conveying roller is provided with a collar. The movement of the rotation shaft of the feed roller within a bearing is restricted, when a trailing edge of the sheet exits from the collar.

19 Claims, 4 Drawing Sheets

SHEET TRANSPORT UNIT AND RECORDER

BACKGROUND OF THE INVENTION

1. Technical Field of the Invention

The present invention relates to a sheet transport unit for separating and conveying a sheet from stacked sheets one by one by a conveying mechanism and for transporting the sheet downstream by a feed roller, and a recorder provided with the sheet transport unit.

2. Description of the Related Art

A transport unit, such as a sheet transport unit used in an ink jet printer has been known, which separates and conveys a sheet from the top of stacked sheets of paper by a conveying (or separating) roller coming into contact with the top of the stacked sheets and, then, feeds the separated sheet in front of a recording head or the like by a feed roller. The conveying roller has an outer circumference section capable of contacting with the sheet on the top of stacked sheets to feed it, and a notch section receded from the outer circumference section. In such transport unit, when a leading edge of the sheet reaches the feed roller and the feed roller starts to feed the sheet, since the notch section of the conveying roller faces a trailing portion of the sheet, the power transmission from the conveying roller to the sheet is interrupted. However, rotatable collars are provided on a coaxial axis with the conveying roller, the distance between the sheet and the conveying roller is held by the collars.

In another type of transport unit, the conveying roller is made to be able to rotate freely after the interruption of power transmission, thereby the conveying roller can support the trailing edge of the sheet which has pulled out by the feed roller.

However, even if the collars or the conveying roller rotates freely, as its resistance is not null, when the trailing edge of a sheet of paper exits from the collars or the conveying roller (hereinafter, conveying roller and collar are collectively called "conveying mechanism"), the resistance exerting on the sheet reduces suddenly, affecting the feed amount by the feed roller.

In other words, while the sheet is subjected to the resistance from the collars or the conveying roller, the feed roller receives a force moving upstream in its feeding direction as a reaction to the sheet transportation. In general, a clearance exists necessarily between the shaft and the bearing of a feed roller and such backlash displaces the feed roller upstream in the feeding direction. When the trailing edge of the sheet exits from the conveying mechanism, its reaction force reduces suddenly, and the feed roller advances downstream in the feeding direction in the clearance, affecting the feed amount. Particularly, when the recorder proceeds to record the next line, after having recorded one line, a line feeding by the feeding roller is performed. If the feed amount of this line feeding is affected, it occurs a problem that the recorded image is disturbed in the image recorder. In the ink jet printer, a line feeding discrepancy of several tens micrometer($\mu$m) badly affects the printing performance.

SUMMARY OF THE INVENTION

It is an object of the present invention to provide an sheet transport unit allowing to achieve an accurate feed by restraining a feed roller movement when the trailing edge of a sheet of paper exits from a conveying unit.

It is another object of the present invention to provide a recorder comprising a conveying unit and a feed roller disposed downstream thereof, allowing to realize a high quality recording, without sheet feed amount variation.

According to a first aspect of the present invention, a sheet transport unit is provided, which comprises:

- a conveying unit having a conveying roller for conveying a sheet from stacked sheets of paper;
- a sheet support on which the stacked sheets of paper are placed and which is biased toward the conveying unit;
- a feed roller for further transporting the sheet conveyed by the conveying unit; and
- a bias member for biasing the feed roller in a direction orthogonal to a rotation shaft of the feed roller.

In a sheet transport unit of the present invention, the conveying roller of the conveying unit separates and conveys a sheet of paper from the top of the stacked sheets of paper, and the feed roller transports the conveyed sheet downstream therefrom. Until a trailing edge of the sheet exits from a position (gap) between the conveying roller and the sheet support biased toward the conveying unit, as a leading (front) portion of the sheet is supported with the feed roller and a trailing portion thereof is supported between the conveying roller and the sheet support or the top of the stacked sheet, the sheet is kept stretched and, in this state, the feed roller receives a traction force F directed to upstream via the sheet (see FIG. 5). As soon as the trailing edge of the sheet exits out of the position between the conveying roller and the sheet support, the force F is lost, and a force exerts on the feed roller so as to move the feed roller downstream due to a reaction to the loss off the force F. The feed roller is usually provided with the bearing which supports the rotation shaft of the feed roller, and the inner diameter of the bearing is formed substantially larger than the shaft outer diameter in order to allow the rotation of the shaft. In other words, the rotation shaft may move slightly in the sheet feeding direction within the bearing. As a consequence, by the reaction to the loss of the force F, the feed roller tends to move slightly downstream. However, as the transport unit is provided with the bias member for biasing the feeding roller in the direction orthogonal to the rotation shaft of the feed roller, for example, in the sheet feeding direction, the feed roller is prevented from moving. Though the biasing direction of the bias member to the feed roller is not limited provided that it is orthogonal to the rotation shaft of the feed roller, however, considering the direction of the force F mentioned above and its reaction force, the bias member is preferably disposed so as to bias the feed roller downstream.

In the sheet transport unit of the present invention, the conveying unit may be so composed to interrupt the driving force, and to idle during the sheet transportation by the feed roller after the conveying roller has rotated for a given amount in order to convey the sheet. Otherwise, the conveying roller may comprise an arcuate circumference section in contact with the sheet, and a notch section which does not come into contact with the sheet, while the conveying unit may comprise a collar of collars disposed rotatably on the same shaft as the conveying roller and for maintaining a distance between the conveying roller and the sheet when the notch section of the conveying roller faces the sheet. In such construction of the conveying roller and the conveying unit, when the sheet feeding is completed by the conveying roller and the notch section faces the sheet, the feed roller pulls out the sheet which is urged downwardly by the collar, and as a result, the collar rotates so as to follow the movement of the sheet. As the consequence, even when the trailing edge of the sheet exits from the collar, the movement of the feed roller is restricted as mentioned before.

The bias member may be composed of a spring, such as coil spring, leaf spring or the like, and the rotation shaft of the feed roller can be biased using the spring. Further, an elastic member, for example, rubber or similar material can be used to bias the feed roller or its rotation shaft in a direction orthogonal to the rotation shaft of the feed roller. Otherwise, a belt may be engaged between the feed roller or its rotation shaft and a roller provided with in the transport unit, to bias the feed roller or its shaft toward the direction orthogonal to the rotation direction of the feed roller by the belt.

According to a second embodiment of the present invention, a recorder is provided, which comprises:

a conveying unit having a conveying roller for conveying a sheet from the top of stacked sheets of paper;

a sheet support on which the stacked sheets of paper are placed and which is biased toward the conveying unit;

a feed roller for further transporting the sheet conveyed by the conveying unit;

a bias member for biasing the feed roller in a direction orthogonal to a rotation shaft of the feed roller; and a recording head disposed downstream from the feed roller.

In the recorder according to the present invention, as the feed roller movement can be controlled as mentioned above, when the trailing edge of a sheet of paper exits from the collar, the feed amount variation during a line feeding is prevented, allowing to provide a high quality recorded image. Particularly, in the ink jet printer, since several tens micrometer($\mu$m) of discrepancy of the line feeding may affect the printing performance, the invention is preferably applied to an ink jet printer recording with dot matrix format.

PREFERRED EMBODIMENTS OF THE INVENTION

An ink-jet type image recorder embodying the present invention will be described below with reference to the accompanying drawings.

Figure 1:
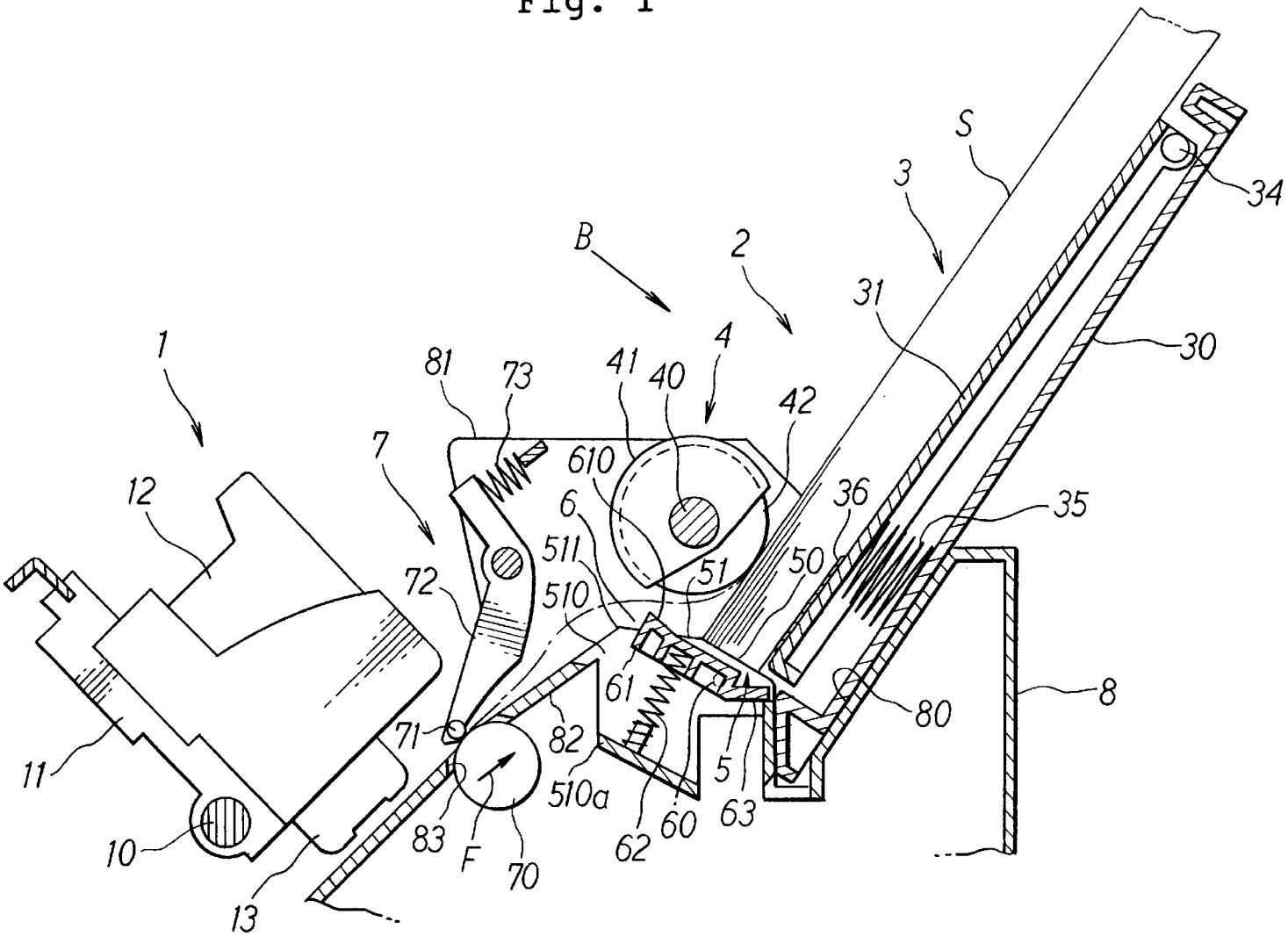
FIG. 1 is a longitudinal cross sectional view of a portion ranged from the hopper to the recording mechanism of an ink jet type image recorder according to an embodiment of the present invention.

As shown in FIG. 1, an image recorder feeds sheets of paper S one by one in front of a recording mechanism 1 by a sheet transport unit 2 and records information on the sheet S. The sheet S is a so-called cut sheet cut into a rectangle of a certain format.

The recording mechanism 1 comprises a carriage 11 reciprocating along a guide rail 10, a ink cartridge 12 supported with the carriage 11 and a recording head 13. The guide rail 10 is disposed in the transverse direction of the sheet S supplied by the sheet feeder 2, in other words, in the direction parallel with the surface of the sheet S and in the direction orthogonal to the sending direction of the sheet S. During recording, the carriage 11 is in the process of being reciprocated by a driving source not shown, such as motor, the recording head 13 discharges ink droplets towards the sheet S passing thereunder, thus, images composed of characters and graphics are recorded on the sheet S with a dot matrix format.

The sheet transport unit 2 comprises a sheet conveying mechanism 3 for storing the sheet S in stacked state and conveying a sheet one by one therefrom, and a feeding mechanism 7 positioned downstream of the sheet conveying mechanism 3 and upstream of the recording mechanism 1. The sheet conveying mechanism 3 comprises a hopper 30 for storing the sheet S in stacked state, a conveying mechanism 4 for conveying the sheet S from the hopper 30, a wall section 5 disposed so that the sheet S sent off from the hopper 30 runs against it, and a stopper mechanism 6 disposed on the wall section 5.

Figure 2:
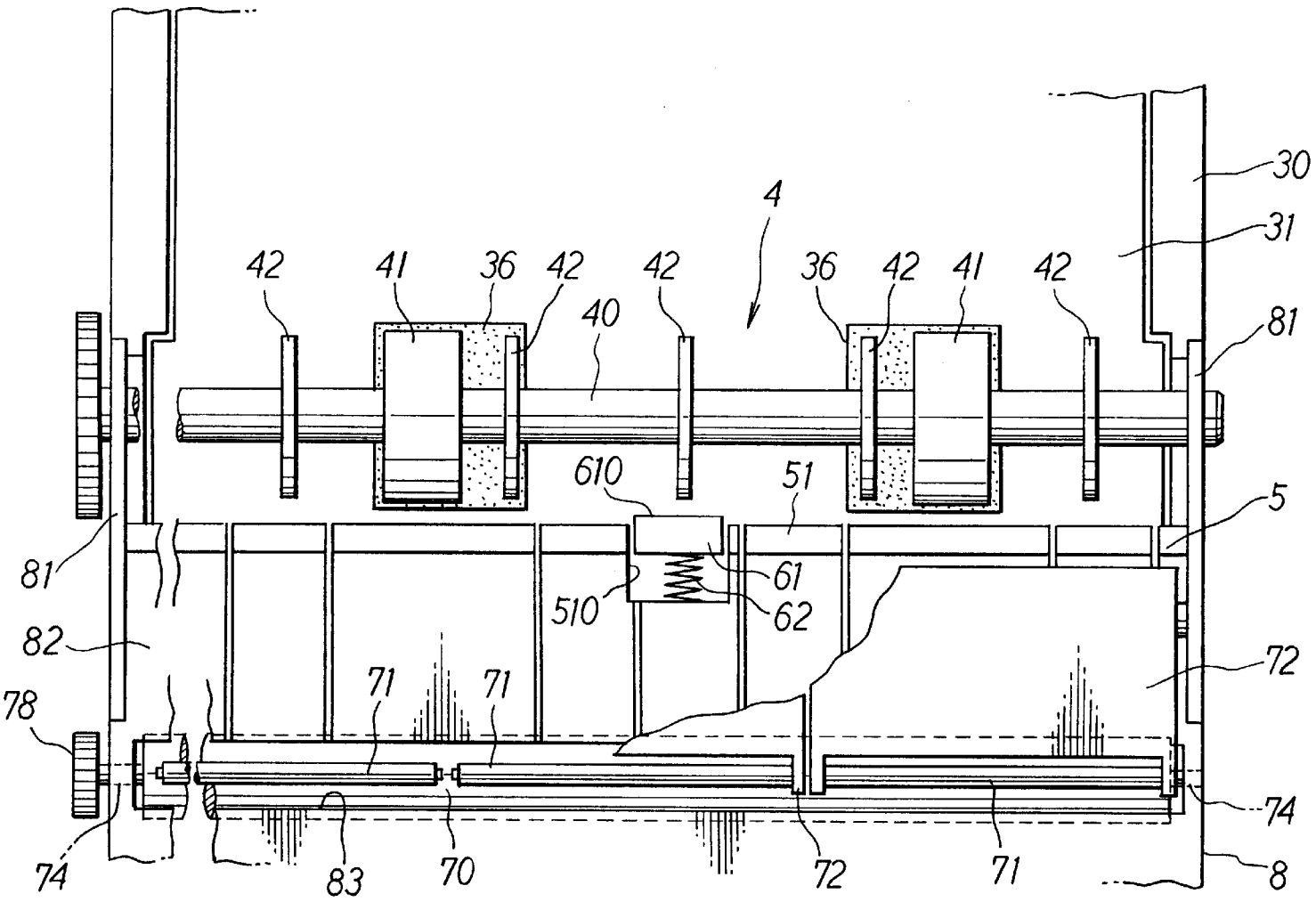
FIG. 2 is a plane view from the direction shown by the arrow B of FIG. 1.

The hopper 30 is supported with a hopper receiving recess 80 formed on a frame 8 of the image recorder in such a manner that a front end side (sending end side of the sheet S) of the hopper 30 is inclined downwardly. A sheet support 31 for supporting the sheet S in stacked state is disposed inside the hopper 30. The sheet support 31 is rotatable about a rotation shaft 34 disposed at the rear end of the hopper 30, and the leading edge side of the sheet S is pushed up and biased toward the conveying mechanism 4 by a spring 35. As shown in FIG. 2, a friction member 36 is attached to the top surface of the sheet support 31, so as to prevent all sheets S from sliding over the top surface of the sheet support 31 and sending off all together when a few sheets of paper S are on the sheet support (for example, two or three sheets). Cork, for example, may be used as the friction member 36.

The conveying mechanism 4 (conveying unit) comprises a support shaft 40 parallel to the transverse direction of the sheet S, a plurality of conveying rollers 41 mounted on the supported shaft 40 at a given interval and a plurality of collars 42. The support shaft 40 is bridged and supported between a pair of side walls 81 erected on the top surface of the frame 8 and is rotatable clockwise in FIG. 1 by a driving source not shown. The conveying roller 41 comprises, as shown in FIG. 3, an outer circumference section 410 curved so as to define the arc coaxial with the support shaft 40 and a notch section 411 receded from this outer circumference section 410 towards the center in the radial direction. The conveying roller 41 is integrally made rotatable with the support shaft 40. The outer circumference section 410 have, in its circumferential direction, a length necessary for sending off a sheet of paper S to a position between an feed roller 70 and a pressure roller 71 of the feeding mechanism 7 described below.

As shown in FIG. 2, the collar 42 is formed similarly to a disk shape having an outer circumferential surface of a constant curvature, and is rotatable relative to the support shaft 40. The outer circumferential surface of the collar 43 has a diameter set a little smaller than the outer diameter of the outer circumference section 410 of the conveying roller 41, and positioned radially outside of the notched section 411 of the conveying roller 41. When the support shaft 40 rotates clockwise as shown in FIG. 1 and the outer circumference section 410 of the conveying roller 41 comes into contact with the sheet S pushed up by the sheet support 31, the uppermost sheet of paper S in the hopper 30 is sent off. When the conveying roller 41 continues to rotate and the notched section 411 is opposed to the hopper 30 side, the sheet S remaining in the hopper 30 runs against the outer circumferential surface of the collar 42. Thereby, after the sheet S is sent off, the collar 42 is rotated following the sheet S transported by the feeding mechanism 7, while keeping the conveying roller 41 in the state separate from the sheet S.

Then, until the sending of the next sheet S is started, the collar 42 prevents the sheets from rising.

As shown in FIG. 1, the wall section 5 is formed integrally with the frame 8 at one side of the hopper receiving recess 80. The detail of the wall section 5 is illustrated by FIG. 3 and FIG. 4. On the wall section 5 are formed a sheet reception surface 50 for receiving the sheet S descending from the front end of the hopper 30 and a slant surface 51 extending upwards from this sheet reception surface 50 and rising as advancing forward in the sending direction from the hopper 30. A sheet passage is formed for the sheet S sent off from the hopper 30, along a passage wall 82 of the frame 8 extending to a position opposed to the recording head 13 continuing from the sheet reception surface 50 on the one side of the hopper reception recess 80.

A recess 510 opening at the sheet passage side is formed on the slant surface 51, and the stopper mechanism 6 mentioned above is disposed in this recess 510. More, the slant surface 51 may be curved, and a protruded stripe section 511 extending in the sending direction may be disposed on the surface thereof. When a protruded stripe section 511 is provided, the top surface of this protruded stripe section 511 defines the shape of the slant surface 51.

The stopper mechanism 6 comprises a stopper 61 capable of haunting from the slant surface 51 by yawing about a shaft 60, and a coil spring 62 for biasing this stopper 61 so as to protrude it from the slant surface 51 to the hopper 30 side. The shaft 60 is disposed upstream in the sending direction in respect to the slant surface 51 and in parallel to the transverse direction of the sheet, while the stopper 61 protrudes from the slant surface 51 an end section opposed to this shaft, namely an end section downstream of the slant surface 51. In this protruded state, a surface 610 of the stopper 61 facing to the hopper side is inclined obtusely viewed from the hopper side, constituting a surface that can be brought into contact with the sheet S. The contact surface 610 has a steeper incline than the slant surface 51 in respect of the sending direction of the sheet S. Moreover, the stopper 61 limits the maximum protrusion position from the slant surface 51, by bringing into contact with the top surface of one side of the recess 510 an arm 63 protruding from one end thereof (shaft side end section).

The stopper 61 is made of a resin similar to the frame, and its rigidity is set high so as to maintain a constant shape against the thrust applied by the sheet S running against the contact surface 610. The thrust of the coil spring 62 to the stopper 61 is set so as to haunt the stopper 61 from the slant surface 51 according to the rigidity of the sheet S, thus assuring an appropriate separation effect according to the rigidity of the sheet S.

In other words, when a sheet S having a high rigidity (for example, thick sheet such as postcard or envelop) pushes the contact surface 610, the stopper 61 is pushed to a substantially same flush plane with the slant surface 51 as shown by a solid line in FIG. 4, namely retracted from the sheet passage, and the sheet S is sent off from the hopper 30 while the front end of the sheet S is sliding over the slant surface 51. At that time, even if a plurality of sheets S is sent off from the hopper 30 at the same time, those sheets S are curved along the slant surface 51 and separated each other. As the result, only the uppermost sheet S climbs over the slant surface 51 pushed by the conveying roller 41.

Figure 3A:
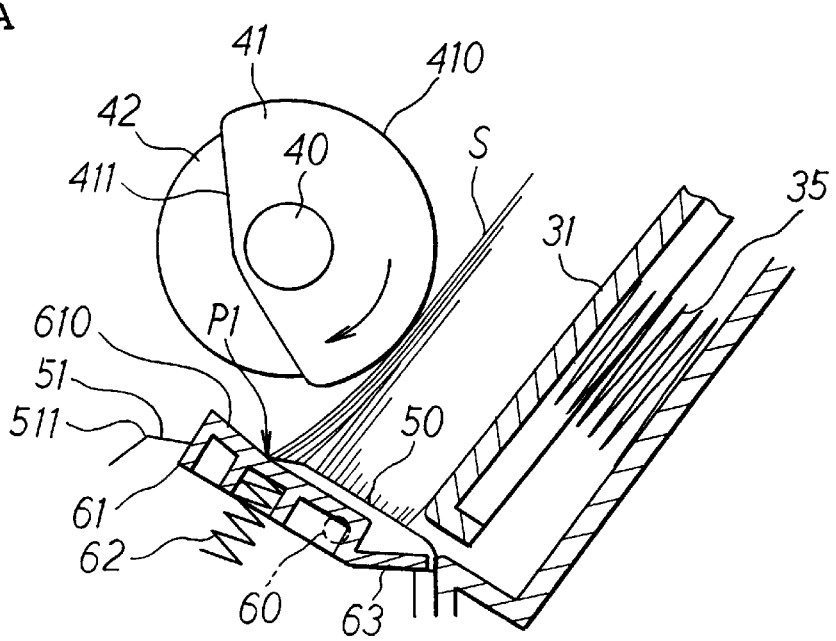
FIGS. 3A, 3B and 3C illustrate the state where a sheet of paper of low rigidity is separated.
Figure 3B:
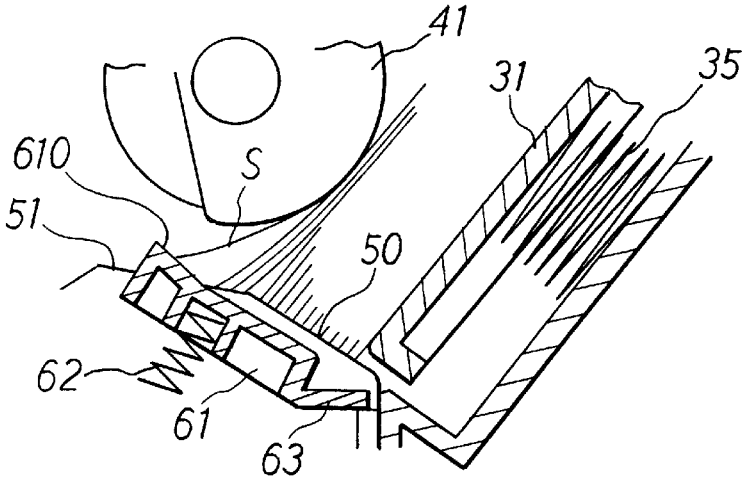
Figure 3C:
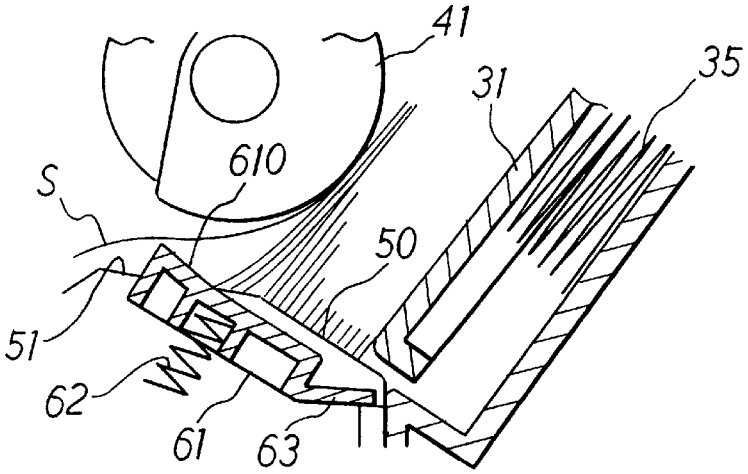
Figure 4:
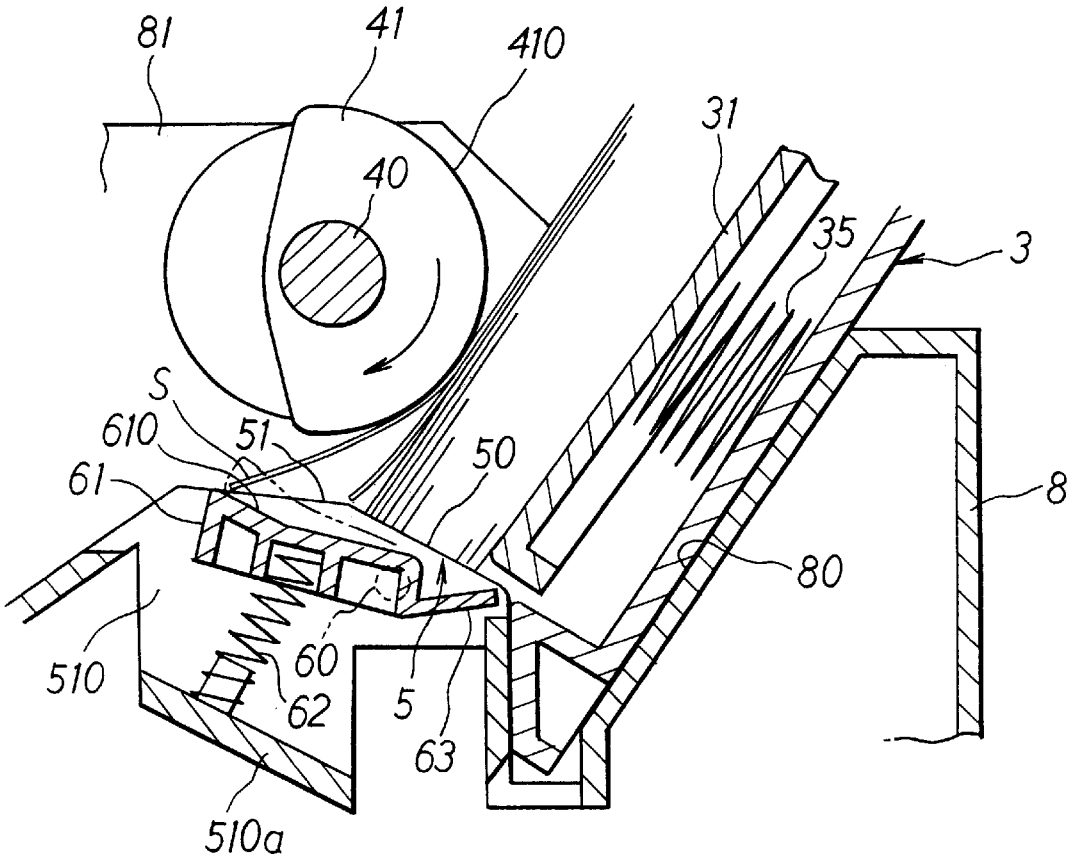
FIG. 4 illustrates the state where a sheet of paper of high rigidity is separated.

On the other hand, when a sheet S having a low rigidity such as usual thin sheet pushes the stopper 61, as shown in FIG. 3A, in the case of the rigidity of such sheet S which the spring 62 is hardly compressed, the stopper 61 emerges from the slant surface 51, but as shown in FIGS. 3B and 3C, the sheet S is curved and sent off climbing over the stopper 61. In this case, as the front end portion of the sheet S is curved larger than the case where the stopper 61 is retracted under the slant surface 51, even a sheet S having a low rigidity is enough separated, and the sheets S under the uppermost sheet of sheet S is restricted securely by the stopper 61.

Thus, as the sheet S of low rigidity is exclusively separated by the stopper 61, the incline of the slant surface 51 is set so as to execute an appropriate separation function to the sheet S having a high rigidity, thereby this permits to separate securely a variety of sheets S independently of their degree of rigidity.

The feeding mechanism 7 is composed of a feed roller 70 and a plurality of pressure rollers 71, and a plurality of lever members 72 each supporting the pressure roller 71. The feed roller 70 exposes the top part of its outer circumference to the sheet passage from an opening portion 83 provided on a wall surface 82 and, as shown in FIG. 2, each pressure roller 71 come into contact with such exposed portion longitudinally. Each pressure roller 71 is supported respectively with each separate lever member 72 and biased by a spring 73 in a direction to come into contact with each feed roller 70. The rotation central shaft line of the feed roller 70 and pressure roller 71 is respectively parallel with the transverse direction of the sheet S.

Figure 5:
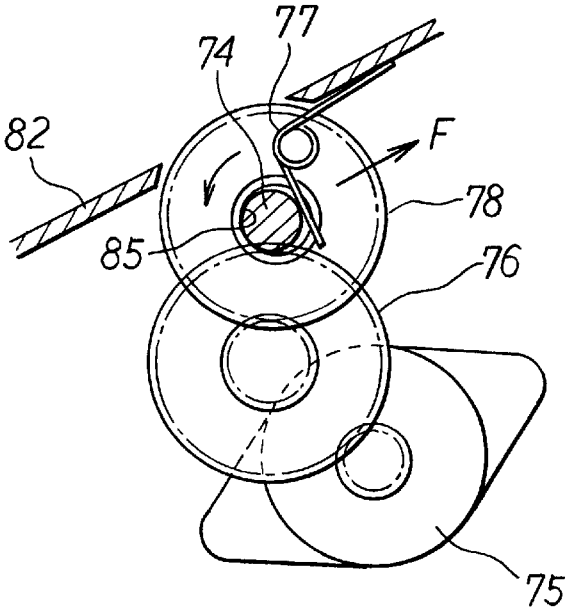
FIG. 5 is a side view of a driving mechanism section of a feed roller.

FIG. 5 illustrates a driving mechanism section of the feed roller 70. A shaft 74 at the both ends of the feed roller 70 is rotatably supported with a bearing hole 85 of the frame 8 and a gear 78 is fixed to one end shaft. A diameter of the bearing hole 85 is larger than that of the shaft 74 so that the shaft 74 is rotatable within the bearing hole 85, thereby the shaft 74 is barely movable within the bearing hole 85. The gear 78 is linked to a motor 75, driving source, via a gear train 76. The shaft 74 of the both ends is biased respectively downstream in the sheet sending direction by a spring 77 as a bias member and inhibited to move freely in a space generated between the respective bearing holes 85.

When the conveying roller 41 in the sheet conveying mechanism 3 rotates clockwise as shown in FIG. 1, a sheet of paper is sent off from the hopper 30. The leading edge of this sheet is brought into contact with a contact point section(nip) between the feed roller 70 and the pressure roller 71. At this time, as the feed roller 70 rotates clockwise as shown in FIG. 1 or is at rest, the sheet S is not transported to the recording head 13 side. In this state, the conveying roller 41 further continues to rotate for a given angle, and the sheet S is curved over the passage wall 82. By this curvature or bending of the sheet S, its front end is positioned at the contact point portion and also the slant afforded on being sent off from the hopper 30 is compensated. Thus, a so-called registration is realized.

Thereafter, the feed roller 70 rotates counterclockwise as shown in FIG. 1, putting the sheet S between the feed roller 70 and the pressure roller 71, and feeding the front end recording position of the sheet to a position facing the recording head 13, while the conveying roller 41 makes one full turn from the start point and stops when the notch section 411 faces the sheet S, in other words, it returns to the initial state as shown in FIG. 1.

Every time the recording mechanism 1 records a line on the sheet S, the feed roller 70 feeds the sheet by a given amount and pulls out the trailing portion of the sheet S from the hopper 30. At that time, since the collar(s) 42 comes into contact with the sheet S remaining in the hopper 30, the collar 42 rotates as the sheet S is pulled out while the conveying roller 41 is held in the state separate from the sheet S. The sheet S, biased by the spring 35, is pressed against the collar 42 and, as the collar 42 rotates with friction against the shaft 40, a given resistance is exerted to the pulling-out of the sheet S by the feed roller 70, so that the sheet S is kept stretched between the collar 42 and the feed roller 70.

Due to the resistance mentioned above, the feed roller 70 receives a force F directed to upstream in the sending (feeding) direction by reaction to the transport of the sheet S and, as a result, tends to move upstream. However, then, as the bias force of the spring 77 for biasing the shaft 74 of the feed roller 70 is larger than the force F, the feed roller 70 remains unmoved.

When the trailing edge of the sheet S exits from the collar 42, the resistance mentioned above reduces suddenly; however then, the feed roller 70 does not move by that, because it is initially biased downstream by the spring 77. Suppose the feed roller 70 is not biased by the spring 77, in the state that the sheet S is kept stretched between the collar 42 and the feed roller 70, when the feed roller 70 moves itself upstream in the sending direction by reaction to the transport of the sheet S, and when the trailing edge of the sheet S exits from the collar 42, the resistance reduces suddenly, and the shaft of the feed roller 70 moves downstream in the bearing hole. In other words, the feed amount by the feed roller 70 becomes incorrect.

According to the embodiments of the present invention mentioned above, as the movement of the feed roller 70 by the resistance variation can be restricted when the trailing edge of the sheet S exits from the collar 42, the feed accuracy can be maintained at high level and the recording dot alignment would not be disturbed, allowing to record images with high precision. Particularly, in those which record at a high resolution by means of ink jet type recording head, as the dot diameter and the dot pitch become extremely fine, even if a high feed accuracy is required a very beautiful image recording can be easily achieved.

Further, in the construction abovementioned, the feed roller 70 is biased by the spring 77 downstream in the sending direction, however the same effect can be achieved also by biasing upstream. It may also be composed so as to make the conveying roller circular and also to omit the collar, besides to interrupt the power transmission after the rotation of the feed roller for a given angle for sending off it and to idle during the transport by the feed roller. Moreover, the sheet transport unit according to the present invention may be applied to a variety of printing units of, not only the ink jet type image recorder, but also the other image recorders of laser type or the like, copy machines, and facsimiles or the like.

What is claimed is:

1. A sheet transport unit, comprising:

a conveying unit having a conveying roller for conveying sheets one by one from stacked sheets of paper in a transport direction;

a sheet support on which the stacked sheets of paper are placed and which is biased toward the conveying unit;

a feed roller for further transporting downstream a sheet conveyed by the conveying unit, the feed roller positioned after the conveying roller in the transport direction;

a shaft and a bearing, said feed roller being mounted on said shaft and said shaft being mounted in said bearing, and a bias member biasing said shaft of the feed roller in the transport direction with respect to the bearing.

2. The sheet transport unit according to claim 1, wherein the rotation shaft of the feed roller is rotatably supported by a bearing.

3. The sheet transport unit according to claim 2, wherein an inner diameter of the bearing is substantially larger than the outer diameter of the rotation shaft of the feed roller, and a movement of the rotation shaft within the bearing is prevented by the bias member.

4. The sheet transport unit according to claim 1, wherein the bias member biases the feed roller downstream in the transport direction thereof.

5. The sheet transport unit according to claim 1, wherein the conveying roller comprises an arc shaped outer circumference section in contact with the sheet and a notch section which does not come into contact with the sheet, and the conveying unit further comprises a collar, disposed rotatably on the same shaft as the conveying roller, for maintaining a distance between the conveying roller and the sheet when the notch section of the conveying roller faces the sheet.

6. The sheet transport unit according to claim 5, wherein a diameter of the collar is smaller than the outer circumference section of the conveying roller and larger than the notch section.

7. The sheet transport unit according to claim 1, wherein the bias member is a spring biasing the rotation shaft of the feed roller.

8. The sheet transport unit according to claim 7, wherein the spring affords to the rotation shaft of the feed roller a biasing force larger than a force exerting on the feed roller when the trailing edge of the sheet exits from the collar.

9. The sheet transport unit according to claim 5, further comprising a pressure roller engaged with the feed roller, wherein the sheet is transported by a nip formed between the feed roller and the pressure roller.

10. A recorder, comprising:

a conveying unit having a conveying roller for conveying sheets one by one from stacked sheets of paper in a transport direction;

a paper support on which the stacked sheets of paper are placed and which is biased toward the conveying unit;

a feed roller for further transporting a sheet conveyed by the conveying unit, the feed roller positioned after the conveying roller in the transport direction;

a shaft and a bearing, said feed roller being mounted on said shaft and said shaft being mounted in said bearing;

a bias member biasing said shaft of the feed roller in the transport direction with respect to the bearing; and a recording head disposed downstream from the feed roller.

11. The recorder according to claim 10, wherein a rotation shaft of the feed roller is rotatably supported with a bearing.

12. The recorder according to claim 11, wherein an inner diameter of the bearing is substantially larger than the outer diameter of the rotation shaft of the feed roller and, a movement of the rotation shaft within the bearing is prevented by the bias member.

13. The recorder according to claim 11, wherein the bias member biases the feed roller downstream in the transport direction thereof.

14. The recorder according to claim 11, wherein the conveying roller comprises an arc shaped outer circumference section in contact with the sheet and a notch section which does not come into contact with the sheet; and the conveying unit further comprises a collar, disposed rotatably on the same shaft as the conveying roller, for maintaining a distance between the conveying roller and the sheet when the notch section of the conveying roller faces the sheet.

15. The recorder according to claim 14, wherein a diameter of the collar is smaller than the outer circumference section of the conveying roller and larger than that of the notch section.

16. The recorder according to claim 11, wherein the bias member is a spring biasing the rotation shaft of the feed roller.

17. The recorder according to claim 16, wherein the spring affords to the rotation shaft of the feed roller a biasing force larger than a force exerting on the feed roller when the trailing edge of the sheet exits from the collar.

18. The recorder according to claim 14, further comprising a pressure roller engaged with the feed roller, wherein the sheet is transported by a nip formed between the feed roller and the pressure roller.

19. The recorder according to claim 11, which is an ink jet printer.

* * * * *